US010717584B2

(12) United States Patent
Borkovec et al.

(10) Patent No.: US 10,717,584 B2
(45) Date of Patent: Jul. 21, 2020

(54) MIXING BOTTLE

(71) Applicant: Fontem Holdings 1 B.V., Amsterdam (NL)

(72) Inventors: Vaclav Borkovec, Hamburg (DE); Nicole Tschierske, Hamburg (DE)

(73) Assignee: Fontem Holdings 1 B.V., Amsterdam (NL)

( * ) Notice: Subject to any disclaimer, the term of this patent is extended or adjusted under 35 U.S.C. 154(b) by 21 days.

(21) Appl. No.: 15/766,769

(22) PCT Filed: Oct. 17, 2016

(86) PCT No.: PCT/EP2016/074874

§ 371 (c)(1),
(2) Date: Apr. 6, 2018

(87) PCT Pub. No.: WO2017/064322

PCT Pub. Date: Apr. 20, 2017

(65) Prior Publication Data

US 2018/0290812 A1 Oct. 11, 2018

(30) Foreign Application Priority Data

Oct. 16, 2015 (EP) ..... 15190224

(51) Int. Cl.
*B65D 81/32* (2006.01)
*B65D 1/04* (2006.01)
*B65D 83/00* (2006.01)

(52) U.S. Cl.
CPC ..... *B65D 81/325* (2013.01); *B65D 1/04* (2013.01); *B65D 81/3227* (2013.01);
(Continued)

(58) Field of Classification Search
CPC .. B65D 1/32; B65D 47/2018; B65D 83/0055; B65D 23/04; B65D 35/22; B65D 35/242; B65D 47/2006; B65D 47/2075; B65D 83/0072; B65D 83/0094; B65D 2217/00; B65D 81/32; B65D 81/3205;
(Continued)

(56) References Cited

U.S. PATENT DOCUMENTS 2,753,990 A * 7/1956 Chalfin ..... B65D 1/04 206/221
3,179,300 A * 4/1965 Davidson ..... B65D 35/46 222/213

(Continued)

FOREIGN PATENT DOCUMENTS

CA 2 297 729 A1 2/1999
CN 2281319 Y 5/1998

(Continued)

*Primary Examiner* — Patrick M. Buechner
(74) *Attorney, Agent, or Firm* — Dykema Gossett PLLC

(57) ABSTRACT

A mixing bottle for mixing two liquids can include a first and a second storage compartment for storing liquids. The first and the second storage compartments can be separated from each other. The mixing bottle can further include a mixing compartment connected to the first storage compartment by a first dosing device of the mixing bottle, connected to the second storage compartment by a second dosing device of the mixing bottle, and connected to an outlet opening of the mixing bottle.

11 Claims, 1 Drawing Sheet

(52) U.S. Cl.
CPC ..... *B65D 81/3255* (2013.01); *B65D 81/3283* (2013.01); *B65D 83/0094* (2013.01)

(58) Field of Classification Search
CPC ..... B65D 81/325; B65D 81/3255; B65D 81/3283; B65D 81/3288; B65D 81/3227; B65D 1/04
See application file for complete search history.

(56) References Cited

U.S. PATENT DOCUMENTS 3,197,071 A * 7/1965 Kuster ..... B65D 81/325 206/219
3,581,940 A * 6/1971 Cella ..... B05B 11/0078 222/94
3,866,800 A * 2/1975 Schmitt ..... B65D 35/22 222/94
5,370,266 A * 12/1994 Woodruff ..... B65D 39/06 215/266
5,897,539 A * 4/1999 Elliesen ..... A61K 9/06 604/289
5,975,364 A * 11/1999 Kaufman ..... B65D 81/3283 222/129
6,286,725 B1 * 9/2001 Gerber ..... B65D 47/2031 222/207
2005/0103801 A1 * 5/2005 Felten ..... B65D 47/2018 222/94
2007/0119861 A1 * 5/2007 Bhagwat ..... B65D 1/32 222/94
2013/0175297 A1 * 7/2013 Sugimoto ..... B65D 83/206 222/135
2014/0261488 A1 9/2014 Tucker

FOREIGN PATENT DOCUMENTS

CN 1475415 Y 2/2004
CN 202156655 U 3/2012
DE 3202275 A1 8/1983
DE 19826245 A1 1/2000
EP 1382536 A1 1/2004
EP 1661820 A1 5/2006
WO 2010133209 A1 11/2010
WO 2014077842 A1 5/2014

* cited by examiner

MIXING BOTTLE

FIELD OF INVENTION

The invention relates generally to mixing bottles, in particular mixing bottles for mixing two liquids.

BACKGROUND OF THE INVENTION

Bottles for providing liquids, for example liquids to be atomized by an electronic smoking device, typically have a storage compartment for storing the liquid. In case two liquids shall be mixed, each of the liquids is provided in a separate bottle and the liquids need to be mixed outside of the bottles. For example, a base liquid and an additional liquid for the electronic smoking device are provided separately and are mixed for consecutively filling the liquids into the smoking device.

SUMMARY OF THE INVENTION

In accordance with one aspect of the present invention, a mixing bottle for mixing two liquids is provided. The mixing bottle comprises a first and a second storage compartment for storing liquids. The first and the second storage compartments are separated from each other. Furthermore, the mixing bottle comprises a mixing compartment. The mixing compartment is connected or connectable to the first storage compartment by a first dosing device of the mixing bottle, for example in a liquid-transmitting manner. The second storage compartment is connected or connectable to the mixing compartment by a second dosing device of the mixing bottle, for example in a liquid-transmitting manner. Moreover, the mixing bottle comprises an outlet opening that is connected to the mixing compartment, e.g. in a liquid-transmitting manner.

The characteristics, features and advantages of this invention and the manner in which they are obtained as described above will become more apparent and be more clearly understood in connection with the following description of exemplary embodiments which are explained with reference to the accompanying drawings.

BRIEF DESCRIPTION OF THE DRAWINGS

In the drawings, same reference signs indicate same elements in each of the views.

DESCRIPTION OF THE PREFERRED EMBODIMENTS

Figure 1:
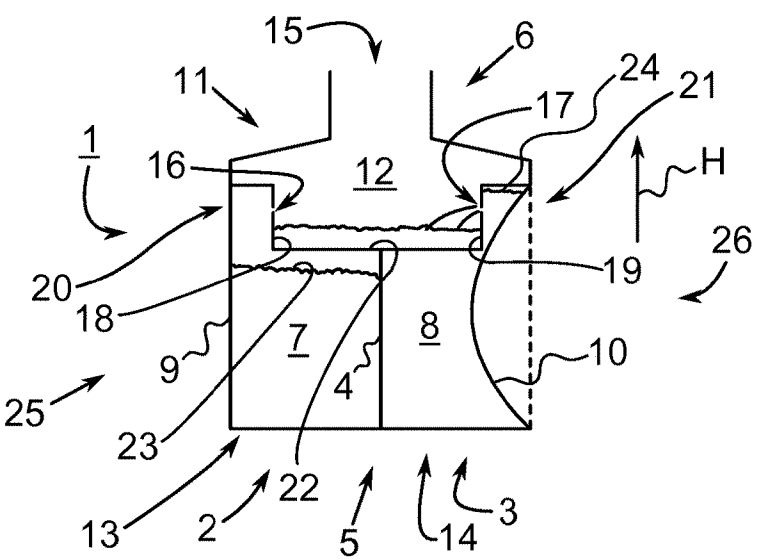
FIG. 1 is a schematic cross-sectional illustration of a first exemplary embodiment of the mixing bottle.

FIG. 1 shows a first exemplary embodiment of the mixing bottle 1 in a schematic cross-sectional view. The mixing bottle comprises a first storage compartment 2 and a second storage compartment 3 for storing liquids. The first and the second storage compartments 2, 3 are separated from each other by a separation wall 4. The separation wall 4 extends parallel to a height direction H from a bottom 5 of the mixing bottle 1 towards a bottleneck 6 of the mixing bottle 1.

Further, the separation wall 4 extends perpendicular to the height direction H, e.g. perpendicular to the plane of projection, between two sections of an outer sidewall of the mixing bottle. Perpendicular to the height direction H and to the separation wall 4, the first and the second storage compartments 2, 3 are arranged after each other.

The first storage compartment 2 comprises a first storage volume 7 and the second storage compartment 3 comprises a second storage volume 8, wherein liquids can be arranged in the first and second storage volumes 7, 8. The first storage volume 7 is arranged between the separation wall 4 and a first outer sidewall section 9 of the mixing bottle 1. The second storage volume 8 is arranged between the separation wall 4 and a second outer sidewall 10 of the mixing bottle 1.

In order to be able to mix liquids stored in the first and second storage compartments 2, 3, the mixing bottle 1 comprises a mixing compartment 11 with a mixing volume 12. In the height direction H, the mixing compartment 11 follows at least one or even both of the first and second storage compartments 2, 3. The first storage volume 7 is connected to the mixing compartment 11 by a first dosing device 13. The second storage volume 8 is connected to the mixing compartment 11 by a second dosing device 14. The dosing devices 13, 14 can interconnect the first storage compartment 2 and the second storage compartment 3 with the mixing compartment 11 in a liquid-conductive manner.

The mixing compartment 11 is furthermore connected to an outlet opening 15 of the mixing bottle 1 in order to be able to empty out mixed liquids from the mixing compartment 11.

The first dosing device 13 comprises a first outlet 16 and the second dosing device 14 comprises a second outlet 17. Via the first and second outlets 16, 17, liquids stored in the first and second storage compartments 7, 8 can flow into the mixing compartment 11, where the liquids mix. Hence, the first and the second outlets 16, 17, can each interconnect one of the first and the second storage compartments 2, 3 with the mixing compartment 11 in a fluid-conducting manner.

The first and second outlets 16, 17 of the exemplary embodiment of FIG. 1 are usually closed, i.e. in case the mixing bottle 1 is not used for mixing liquids stored in the first and the second storage compartments 2, 3, no liquid flows through any of the first and the second outlets 16, 17 from the first and second storage compartments 2, 3 into the mixing compartment 11.

The first storage compartment 2 comprises a first outlet sidewall 18 and the second storage compartment 3 comprises a second outlet sidewall 19, wherein the first and second outlets 16, 17 are arranged in the respective first and second outlet sidewall 18, 19. The first and second outlet sidewalls 18, 19 extend essentially parallel to the height direction H. Alternatively, the first and second outer sidewalls 18, 19 may be arranged at a predetermined angle to the height direction H and for example perpendicular to the height direction H.

According to the exemplary embodiment of FIG. 1, the first and second outlet sidewalls 18, 19 extend essentially parallel to the height direction H and are part of first and second dosing protrusions 20, 21 of the first and second storage compartments 2, 3. The first and second storage volumes 7, 8 extend into the first and second dosing protrusions 20, 21. The first and second dosing protrusions 20, 21 protrude from a bottom 22 of the mixing compartment 11 along the height direction H and away from the bottom 5 of the mixing bottle 1. The bottom 22 of the mixing compartment 11 according to the exemplary embodiment of FIG. 1 is essentially arranged perpendicular to the height direction H. The mixing compartment 11 is at least section wise arranged between the first and second storage compartments 2, 3 and in particular between the first and second dosing protrusions 20, 21.

The mixing compartment 11 completely spans over the first and the second storage compartments 2, 3 perpendicular to the separation wall 4 and/or to the height direction H. The first outlet 16 faces the second outlet 17. Alternatively, the first and the second outlets 15, 16 face in the height direction H.

The mixing bottle 1 is shown with first and second liquids 23, 24, each of which being arranged in one of the storage compartments 2, 3.

According to the exemplary embodiment of FIG. 1, the first and second outer sidewall sections 9, 10 of the mixing bottle 1 are flexible and can be pressed inwards, i.e. towards a centre of the mixing bottle 1, for example towards the separation wall 4. For example, in case the second outer sidewall section 10 is pressed towards the separation wall 4, the second liquid 24 in the second storage compartment 3 is displaced. The displacement of the liquid results in an increasing pressure within the second storage compartment 3. In case at least one of the first and second outlets 16, 17 and in particular the second outlet 17 is adapted to be openable by overpressure in the respective storage compartment 2, 3 with respect to the mixing compartment 11, the respective liquid and for example the second liquid 24 is pressed through the second outlet 17 of the second dosing device 14 into the mixing volume 12 of the mixing compartment 11. For example, at least one or even both of the first and second outlets 16, 17 can be provided as a nozzle that is flexible and is pressed open by the overpressure and closes again after the overpressure has dropped below a predetermined value. The first liquid 23 can be transferred from the first storage compartment 2 into the mixing compartment 11 similar to the second liquid 24, in case the first outer sidewall section 9 is flexibly pushable towards the centre of the mixing bottle 1 and for example towards the separation wall 4.

In case there is not enough liquid 23, 24 in the respective storage compartment 2, 3 in order to displace the liquid 23, 24 such that it reaches the respective outlet 16, 17, the mixing bottle 1 may be held upside down, i.e. bottom-up, such that the bottleneck 6 and/or the outlet opening 15 faces downwards. In order to be able to mix the liquids 23, 24 in the mixing compartment 11, the outlet opening 15 would need to be closed when holding the mixing bottle 1 upside down.

The flexible first and second outer sidewall sections 9, 10 each form a first and second pump mechanism 25, 26 for pumping the liquids 23, 24 from one of the storage compartments 2, 3 into the mixing compartment 11. The pump mechanisms 25, 26 are shown as displacement pumps with manually actuatable displacement elements. According to the exemplary embodiment of FIG. 1, the flexible sidewall sections 9, 10 provide such displacement elements.

Figure 2:
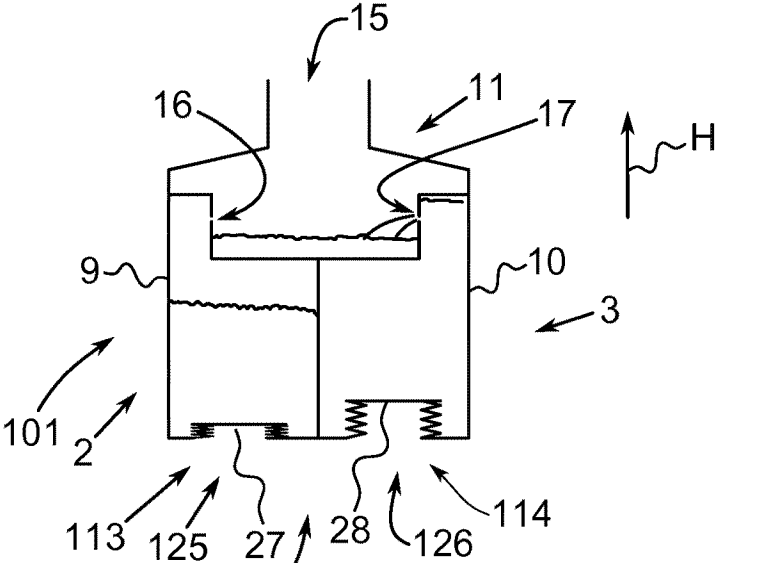
FIG. 2 is a cross-sectional view of a second exemplary embodiment of the mixing bottle.

FIG. 2 shows another exemplary embodiment of the mixing bottle in a cross-sectional view. For the sake of brevity, only the differences from the exemplary embodiment of FIG. 1 are looked at in the following.

The mixing bottle 101 of the exemplary embodiment of FIG. 2 comprises the first and second storage compartments 2, 3 and the mixing compartment 11. The first and second pump mechanisms 125, 126 of the first and second dosing devices 113, 114, however, are formed with displacement elements that are not provided by the outer sidewall sections 9, 10. Rather, the displacement elements are formed by first and second bases 27, 28 of the respective storage compartments 2, 3. The first and second bases 27, 28 are arranged at the bottom 5, for example at ends of the respective storage compartment 2, 3 opposite of the outlet opening 15 or of the bottleneck 6 of the mixing bottle 101. The first and second bases 27, 28 can be formed flexible such that they can be deformed into the mixing bottle 101, for example along the height direction H and/or towards the outlet opening 115. Alternatively, and as shown in FIG. 2, the pump mechanisms 125, 126 can be formed as bellows pumps, which may provide for a larger stroke or treble of the first and second bases 27, 28 compared to flexibly formed first and second bases 27, 28.

In particular, according to the exemplary embodiment of FIG. 2, the first and second bases 27, 28 are separate bases of the mixing bottle 101.

Figure 3:
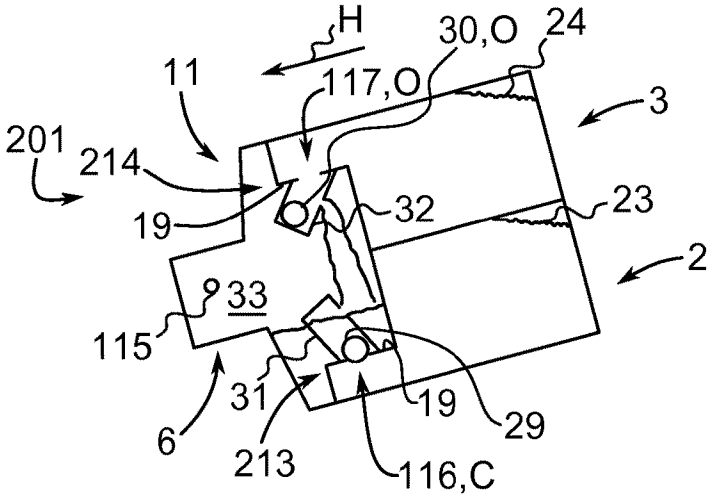
FIG. 3 shows a schematic cross-sectional view of yet another exemplary embodiment of the mixing bottle.

FIG. 3 shows another exemplary embodiment of the mixing bottle. For the sake of brevity, only the differences to the exemplary embodiment of FIG. 3 with respect to the previous exemplary embodiments are looked at in the following.

The mixing bottle 201 of the exemplary embodiment of FIG. 3 is shown tilted such that the first and second liquids 23, 24 have flown towards the first and second outlets 116, 117 of the first and second dosing devices 213, 214. The first and second outlets 116, 117 face each other perpendicular to the height direction H. The first and second outlets 116, 117 may be outlet openings that are normally open, i.e. that let fluid pass in case the mixing bottle 201 is not in use.

In order to be able to close one of the outlets 116, 117, the first and second dosing devices 213, 214 each comprise a first or a second closing element 29, 30. The first and second closing elements 29, 30 of the exemplary embodiment of FIG. 3 are shown as spheres or balls. The first and second dosing devices 213, 214 comprise first and second guiding elements 31, 32 for guiding the first and second closing elements 29, 30, respectively.

The first and second guiding elements 31, 32 guide the first and second closing elements 29, 30 between their closed and opened positions C, O. Furthermore, the first and second guiding elements 31, 32 are permeable for liquid and may be formed by guiding bars or guiding cages that do not unduly hinder liquid flowing into the mixing compartment 11. The first and second guiding elements 31, 32 extend from the from the first and second outlet sidewalls 18, 19 into the mixing compartment 11. For example, the first and second guiding elements 31, 32 extend at least partly towards each other and along the height direction H, i.e. towards the bottleneck 6, for example towards the outlet opening 115.

In the position of the mixing bottle 201 shown in FIG. 3, the first closing element 29 closes the first outlet 116. Hence, the first closing element 29 is shown in its closed position C. The first closing element 29 is held in its closed position C by gravitational forces. In case the weight of the first closing element 29 is not sufficient for holding the first outlet 16 closed, a spring element may be provided that pushes the first closing element 29 in its closed position C. The spring element is adapted to push the first closing element 29 in its closed position C, in case the gravitational forces draw the first closing element 29 into its closed position C. In case the gravitational forces seek to pull the first closing element 29 out of its closed position C, e.g. into its opened position, the spring element would need to be adapted to let the first closing element 29 move out of its closed position C due to the gravitational forces.

Hence, the first and second closing elements 29, 30 have a higher density than the liquids 23, 24 in the mixing bottle 201 and for example a higher density than water. The first and second closing elements 29, 30 are for example formed as solid steel balls.

The second closing element 30 is shown in its opened position O, which is arranged at a distance to the second outlet 17. Hence, liquid 24 can flow out of the second storage compartment 3 via the opened, i.e. not blocked, second outlet opening 17 into the mixing compartment 11. No liquid 23 flows from the first storage compartment 2 via the first outlet 16, as the first outlet 16 is blocked by the first closing element 29.

The outlet opening 115 may be arranged at a sidewall section 33 of the bottleneck 6 that essentially extends parallel to the height direction H. In particular, the first and second outlets 16, 17 may be arranged in a common plane that extends parallel to the height direction H, wherein the outlet opening 115 is arranged at a distance to this common plane. For example, the sidewall section 33 that comprises the outlet opening 115 may extend essentially parallel to the common plane.

The mixing bottle 201 may be formed with the flexible sidewalls 9, 10 of the mixing bottle 1, and/or with the first and second based 27, 28 of the mixing bottle 101, in order to improve or facilitate flow of liquid into the mixing compartment 11.

Figure 4:
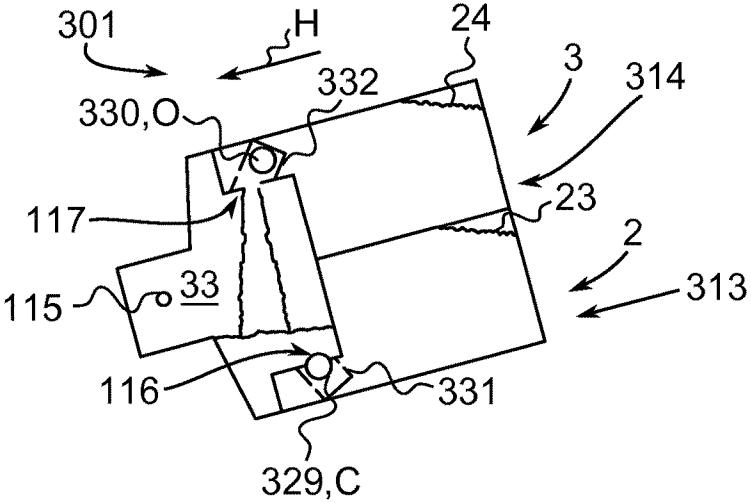
FIG. 4 is a schematic cross-sectional illustration of another exemplary embodiment of the mixing bottle.

FIG. 4 shows another exemplary embodiment of the mixing bottle. For the sake of brevity, only the differences to the exemplary embodiment of FIG. 3 are looked at in the following.

The mixing bottle 301 of the exemplary embodiment of FIG. 4 essentially differs from the mixing bottle 201 of the exemplary embodiment of FIG. 3 by its dosing devices 313, 314. In particular, the first and second guiding elements 331, 332 of the dosing devices 313, 314 of the mixing bottle 301 are each arranged in one of the first and second storage compartments 2, 3 instead of in the mixing compartment 11. The first and second guiding elements 331, 332 extend away from each other and against the height direction H, e.g. away from the closest first and second outlets 116, 117. In order to open and close the first and second outlets 116, 117, the first and second closing elements 329, 330 are adapted to be actuated by buoyancy forces caused by the liquid 23, 24 in the respective storage compartment 2, 3. Hence, density of the first and second closing elements 329, 330 is less than the density of the liquids 23, 24 and in particular of water.

In the position of the mixing bottle 301, the first closing element 329 is pressed into the first outlet 116 by buoyancy forces caused by the first liquid 23. Hence, the first closing element 329 is shown in its closed position C. The second closing element 330 is lifted off of the second outlet 17, such that liquid 24 can flow out of the second storage compartment 3 and into the mixing compartment 11 via the second outlet 117. Hence, the second closing element 330 is shown in its opened position O.

The mixing bottle 301 may be formed with the flexible sidewalls 9, 10 of the mixing bottle 1, and/or with the first and second based 27, 28 of the mixing bottle 101, in order to improve or facilitate flow of liquid into the mixing compartment 11. In case the displacement element of the dosing device, whose closing element is deliberately placed in its closed position C is actuated, the increasing pressure presses the closing element stronger in the respective outlet and improved sealing effect of this closing element. When actuating the displacement element of the dosing device, whose closing element is deliberately placed in its opened position O, flow of liquid is increased.

In summary, in one aspect, the mixing bottle for mixing two liquids comprises a first and a second storage compartment for storing liquids, the first and the second storage compartments being separated from each other. Furthermore, the mixing bottle comprises a mixing compartment. The mixing compartment is connected to the first storage compartment by a first dosing device, for example in a liquid-transmitting manner. The second storage compartment is connected to the mixing compartment by a second dosing device, for example in a liquid-transmitting manner. Furthermore, the mixing bottle comprises an outlet opening that is connected to the mixing compartment in a liquid-transmitting manner.

An advantage of this mixing bottle may be that two liquids can be mixed within the mixing bottle, such that the liquids do not need to be filled into a separate mixing vessel, thereby reducing the risk of spilling the liquids. Hence, the liquids do not need to be mixed in a liquid reservoir of an electronic smoking device, in case the liquids of the mixing bottle shall be used and for example vaporized or atomized in the electronic smoking device. Mixing the liquids in the electronic smoking device, namely, makes it difficult to measure the liquids to be mixed.

According to an embodiment, the first dosing device comprises a first outlet and the second dosing device comprises a second outlet, the first and second outlets interconnecting the first and second storage compartments with the mixing compartments. An advantage of this embodiment may be that separately connecting the first and second storage compartments via the first and second outlets with the mixing compartment reduces the risk that liquid from one of the storage compartments enters the other one of the storage compartments.

According to an embodiment, the first and the second outlets are usually or normally closed. An advantage of this embodiment may be that usually or normally closed first and second outlets may provide that liquids do not inadvertently flow from one of the storage compartments into the mixing compartments.

According to an embodiment, at least one of the first outlet and the second outlet is adapted to be openable by overpressure, in the respective storage compartment, i.e. a pressure in the respective storage compartment that is higher than the pressure in the mixing compartment. In particular, at least one of the first outlet and the second outlet is adapted to open in case the pressure difference between the respective storage compartment and the mixing compartment is higher than a predetermined pressure difference. Further, at least one of the first outlet and the second outlet is adapted to close again, in case the pressure difference falls below the predetermined pressure difference. For example, both of the first and second outlets can be adapted to be openable by the overpressure. Thus, an advantage of this embodiment may be that the liquids can be easily pressed through the outlets into the mixing compartment. For example, at least one or even both of the first outlet and the second outlet is provided as a nozzle or orifice, which is flexible and which opens due to the overpressure and closes in case the overpressure falls below a predetermined value.

According to an embodiment, at least one of the first dosing device and the second dosing device may comprise a closing element for closing the outlet by gravitational forces. Again, for example, both of the first and second dosing devices may each comprise such a closing element. The closing element may be a sphere or a ball with a higher density than one of the liquids to be mixed, in particular higher than the density of water. The closing elements may be provided as solid spheres or balls, for example formed by metal, e.g. stainless steel.

Alternatively, the at least one closing element for closing the outlet may be adapted to close the outlet by buoyancy forces caused by the liquid in the respective storage compartment. Again, both of the closing elements may be adapted to close the respective outlet by buoyancy forces. The first and second closing elements, hence, may have a density that it less than the density of the liquids to be mixed and, for example, less than the density of water. An advantage of such embodiments may be that the respective outlet can be opened without increasing the pressure within the mixing bottle.

According to an embodiment, the mixing bottle may comprise at least one pump mechanism for pumping liquid from one of the first storage compartment and the second storage compartment into the mixing compartment. In particular, the mixing bottle may comprise two separate pump mechanisms, wherein one of the pump mechanisms is provided for pumping liquid from one of the storage compartments into the mixing compartment, and the other pump mechanism is provided for pumping liquid from the other of the storage compartments into the mixing compartments. An advantage of such an embodiment may be that due to the pump mechanism, pressure in the respective storage compartment can be increased such that liquid flows faster into the mixing compartment, in order to open the outlet and/or in order to press the buoyancy closing element against the outlet. Furthermore, even in case the weight of the respective liquid is insufficient in order to build sufficient pressure for opening the respective outlet, for example if not enough liquid is present in the respective storage compartment, such liquid can still be filled into the mixing compartment.

According to an embodiment, the pump mechanism may be a displacement pump with a manually actuatable displacement element, the displacement element being formed by a flexible sidewall section of one of the storage liquid compartments. In particular, both of the storage liquid compartments may comprise flexible sidewalls. An advantage of such an embodiment may be that such a pump mechanism can be easily formed when forming the mixing bottle with the displacement elements being the flexible sidewalls.

Alternatively or additionally, the displacement pump may comprise manually actuatable displacement elements that are formed by bases of the storage compartments.

According to an embodiment, the mixing bottle may comprise two pump mechanisms, one for pumping liquid from the first storage compartment into the mixing compartment, and one for pumping liquid from the second storage compartment into the mixing compartment. Hence, in case two pump mechanisms are provided, the bases of the first storage compartment and the second storage compartment may be separate bases of the mixing bottle. An advantage of such an embodiment may be that the liquids can be pumped into the mixing compartment separated from each other, thereby avoiding unintended mixing of the liquids.

According to an embodiment, the mixing bottle may comprise a separation wall that separates storage volumes of the first and second storage compartments from each other. The mixing compartment may be arranged at least section wise between the first and the second storage compartments. An advantage of this embodiment may be that the volume of the mixing compartment may be increased.

According to an embodiment, the mixing compartment may completely span over the first and the second storage compartments perpendicular to the separation wall. An advantage of this embodiment may be that the volume of the mixing compartment is even further increased.

According to an embodiment, the first outlet and the second outlet may face each other. An advantage of this embodiment may be that liquid that flows into the mixing compartment causes flow of liquid in the mixing compartment, such that the liquids better mix within the mixing compartment.

While this invention has been described in connection with what is presently considered to be practical exemplary embodiments, it is to be understood that the invention is not limited to the disclosed embodiments, but, on the contrary, is intended to cover various modifications and equivalent arrangements included within the scope of the appended claims.

LIST OF REFERENCE SIGNS

1, 101, 201, 301 mixing bottle
2 first storage compartment
3 second storage compartment
4 separation wall
5 bottom of mixing bottle
6 bottleneck of mixing bottle
7 first storage volume
8 second storage volume
9 first outer sidewall section/displacement element
10 second outer sidewall section/displacement element
11 mixing compartment
12 mixing volume
13, 113, 213, 313 first dosing device
14, 114, 214, 314 second dosing device
15, 115 outlet opening
16, 116 first outlet
17, 117 second outlet
18 first outlet sidewall
19 second outlet sidewall
20 first dosing protrusions
21 second dosing protrusions
22 bottom of dosing protrusions
23 first liquid
24 second liquid
25, 125 first pump mechanism
26, 126 second pump mechanism
27 first base/displacement element
28 second base/displacement element
29, 329 first closing element
30, 330 second closing element
31, 331 first guiding element
32, 332 second guiding element
33 sidewall section of 6
C closed position of 29, 30
H height direction
O opened position of 29, 30

The invention claimed is:

1. A mixing bottle for mixing two liquids, comprising:

a first and a second storage compartment for storing liquids, the first and the second storage compartments being separated from each other; and a mixing compartment, the mixing compartment being connected to the first storage compartment by a first dosing device of the mixing bottle, to the second storage compartment by a second dosing device of the mixing bottle, and to an outlet opening of the mixing bottle, wherein the first dosing device comprises a first outlet, and the second dosing device comprises a second outlet, the first and the second outlets interconnecting the first and the second storage compartments with the mixing compartment, and at least one of the first dosing device and the second dosing device comprises a closing element for closing the respective outlet by buoyancy forces caused by an increase in liquid in the respective dosing device.

2. The mixing bottle according to claim 1, wherein at least one of the first outlet or the second outlet are adapted to be openable by overpressure in the respective first or second storage compartment with respect to the mixing compartment.

3. The mixing bottle according to claim 1, wherein at least one of the first outlet or the second outlet are provided as a nozzle.

4. The mixing bottle according to claim 1, wherein the first outlet and the second outlet face each other.

5. The mixing bottle according to claim 1, wherein the mixing bottle comprises two pump mechanisms, one for pumping liquid from the first storage compartment into the mixing compartment and another one for pumping liquid from the second storage compartment into the mixing compartment.

6. The mixing bottle according to claim 5, wherein bases of the first storage compartment and the second storage compartment are separate bases of the mixing bottle.

7. The mixing bottle according to claim 1, wherein the mixing bottle comprises a separation wall that separates storage volumes of the first and the second storage compartments from each other, wherein the mixing compartment is at least sectionwise arranged between the separation wall and the outlet opening.

8. The mixing bottle according to claim 7, wherein the mixing compartment completely spans over the first and the second storage compartments perpendicular to the separation wall.

9. The mixing bottle according to claim 1, wherein the mixing bottle comprises at least one pump mechanism for pumping liquid from one of the first storage compartment and the second storage compartment into the mixing compartment.

10. The mixing bottle according to claim 9, wherein the pump mechanism is a displacement pump with a manually actuatable displacement element, the displacement element being formed by a flexible sidewall section of one of the first storage compartment and the second storage compartment.

11. The mixing bottle according to claim 9, wherein the pump mechanism is a displacement pump with a manually actuatable displacement element, the displacement element being formed as a base of one of the first storage compartment and the second storage compartment.

* * * * *